US006390852B1

(12) United States Patent
Wang

(10) Patent No.: US 6,390,852 B1
(45) Date of Patent: May 21, 2002

(54) CABLE CONNECTOR ASSEMBLY WITH AN IMPROVED GROUNDING STRUCTURE

(75) Inventor: Huawei Wang, Künsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/748,838

(22) Filed: Dec. 26, 2000

(30) Foreign Application Priority Data

Oct. 17, 2000 (TW) ..... 89217977

(51) Int. Cl.[7] ..... H01R 13/648
(52) U.S. Cl. ..... 439/610; 439/96
(58) Field of Search ..... 439/607–610, 439/95, 96, 98

(56) References Cited

U.S. PATENT DOCUMENTS 5,788,528 A * 8/1998 Orr, Jr. et al. ..... 439/96
6,106,334 A * 8/2000 Kuo ..... 439/610

* cited by examiner

*Primary Examiner*—Gary Paumen
(74) *Attorney, Agent, or Firm*—Wei Te Chung

(57) ABSTRACT

A cable connector assembly (100) includes a cable set (5) and an electrical connector (8). The cable set has a plurality of signal wires (52) and a grounding wire (51), surrounded by a shielding braid (50). The connector has a dielectric housing (1) with a plurality of terminals (4) mounted therein, an upper shell (2) and a lower shell (3) defining a receiving space (30) for receiving the housing therein. The upper shell comprises a rectangular panel (24), a collarlike strip (23) connecting to the rectangular panel, and a pair of side panels (21). The lower shell includes a top plate (33), a bottom plate (34) and side plates (31) each defining a soldering tab (312) thereon. The grounding wire is soldered to a soldering tab and the signal wires are soldered to corresponding terminals. The strip is crimped to the cable set.

1 Claim, 4 Drawing Sheets

CABLE CONNECTOR ASSEMBLY WITH AN IMPROVED GROUNDING STRUCTURE

BACKGROUND OF THE INVENTION

1. Field of the Invention

The present invention relates to a cable connector assembly used in telecommunications, and particularly to a cable connector assembly with an improved grounding structure.

2. Description of the Related Art

A cable connector assembly used for data transmission can often be adversely affected in its function by Electro Magnetic Interference (EMI), which can impede the transmission of information. To protect the cable connector assembly from EMI, a conventional solution is to ground a shielding braid of a cable to a corresponding connector shield. Referring to FIG. 4, a grounding wire 741 of a braid (not labeled) of a cable 74 is soldered to an outer surface of a circular metal strip 731 of a connector shield (not labeled) inside a transparent insulation 72 of a conventional connector 70. However, such a configuration leads to an irregular surface of the strip 731 and a soldering point 71 of the grounding wire 741 is often destroyed during injection molding the insulation 72 thereon. Additionally, the soldering point 71 is not attractive in appearance in the final product.

Hence, an improved cable connector assembly with a grounding structure which overcomes the above-mentioned disadvantages of a conventional cable connector assembly is required.

SUMMARY OF THE INVENTION

A first object of the present invention is to provide a cable connector assembly with an improved grounding structure wherein a grounding wire of a cable braid is more reliably connected to a connector shield of the grounding structure.

A second object of the present invention is to provide a cable connector assembly with an improved grounding structure wherein assembly of the cable connector assembly is more convenient.

A further object of the present invention is to provide a cable connector assembly with an improved grounding structure which has a more attractive appearance.

To achieve the aforementioned objects, a cable connector assembly comprises a shielded cable set and an electrical connector. The electrical connector includes a dielectric housing retaining a plurality of terminals therein and a shield including an upper shell and a lower shell defining a receiving space therebetween for receiving the dielectric housing therein. The lower shell has a top plate, a bottom plate and side plates each defining a soldering tab thereon. A cable set comprises a plurality of signal wires and a grounding wire connected to a shielding braid which surrounds the signal and grounding wires. The grounding wire is soldered to a soldering tab of the lower shell inside the receiving space and the signal wires are soldered to a corresponding terminal for establishing an electrical connection therebetween.

DESCRIPTION OF THE PREFERRED EMBODIMENT

Figure 1:
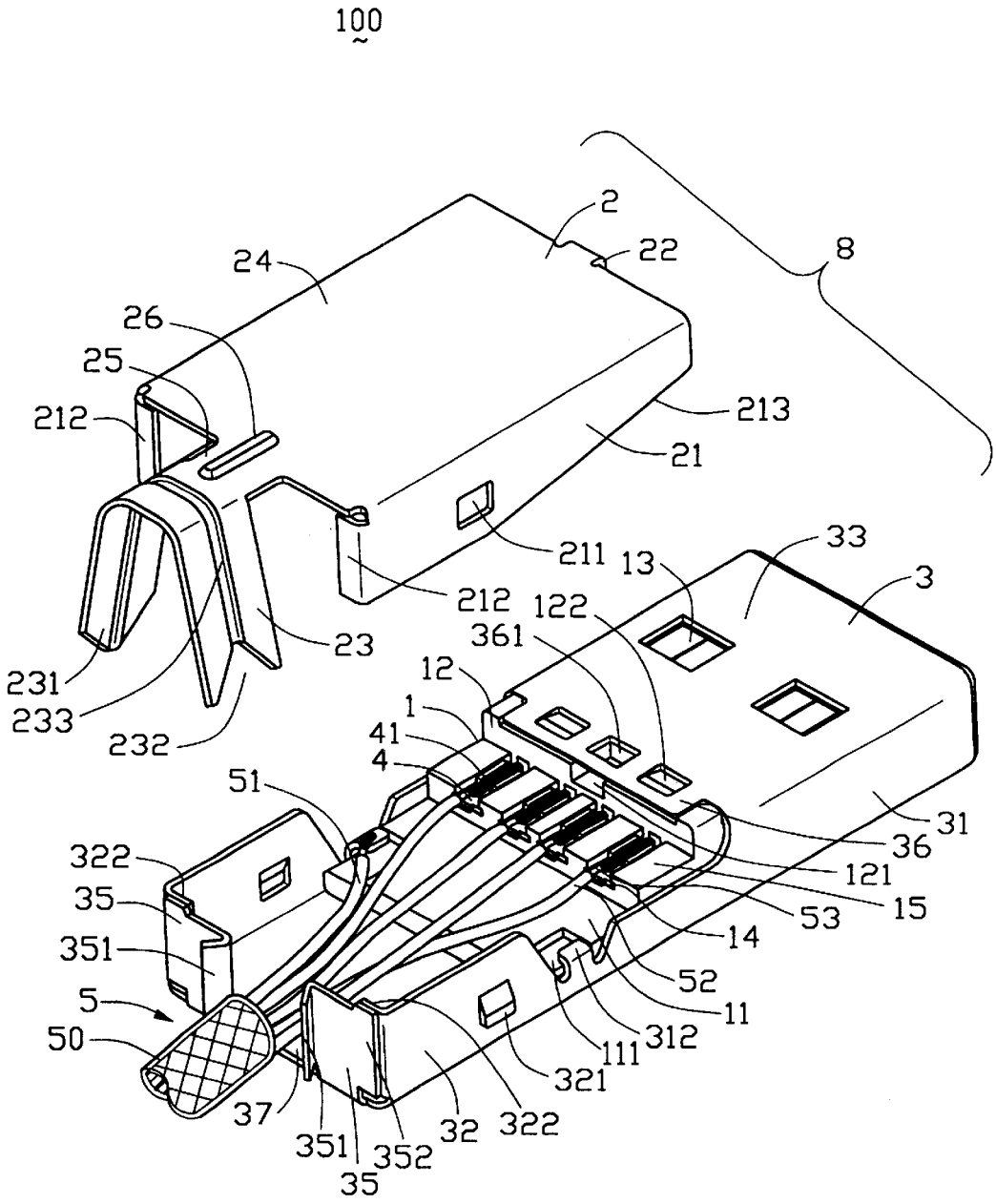
FIG. 1 is a partially assembled view of a cable connector assembly in accordance with the present invention.

Referring first to FIG. 1, a cable connector assembly 100 in accordance with the present invention is comprised of a Universal Serial Bus connector 8 and a shielded cable set 5.

The electrical connector 8 comprises a dielectric housing 1 having a plurality of terminals 4 therein, an upper shell 2 and a lower shell 3. The upper shell 2 has a rectangular panel 24 and a pair of side panels 21 extending downwardly from two opposite longitudinal edges of the panel 24. Each side panel 21 has an angled edge 213 sloping downward from a front of the side panel 21. Each side panel 21 further forms a retaining tab 212 extending inwardly and perpendicular to a rear of the side panel 21. A hole 211 is defined toward the rear of each side panel 21. The panel 24 forms a detent 22 at a middle of a front edge thereof and a connecting beam 25 opposite to the detent 22 with an elongate protrusion 26 thereon. A collarlike strip 23 extends from a rear edge of the connecting beam 25 and forms a triangular projection 231 at one end thereof and a triangular cutout 232 at an opposite end. The strip 23 further defines a groove 233 running longitudinally the length of the strip 23.

Figure 2:
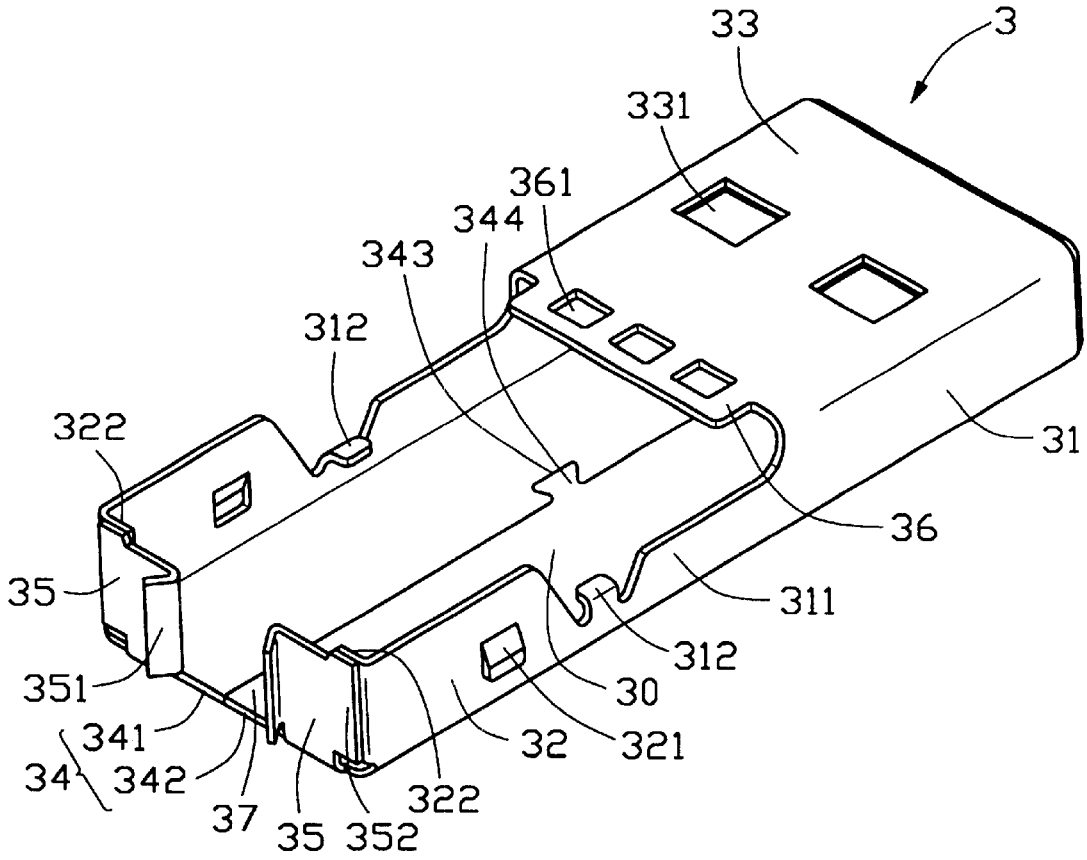
FIG. 2 is a perspective view of a lower shell of an electrical connector of the cable connector assembly of FIG. 1.

Referring to FIG. 2, the lower shell 3 is formed from one piece of stamped metal sheet and comprises a top plate 33, a bottom plate 34 including a first half 341 and a second half 342, and a pair of side plates 31 defining a receiving space 30 therebetween for receiving the dielectric housing 1. A pair of rectangular holes 331 is defined in each of the top and the bottom plates 33, 34 (only one pair shown). A transverse pad 36 extends from a rear edge of the top plate 33 and a plurality of apertures 361 are defined in a row between a rear edge of the transverse pad 36 and the rectangular holes 331 of the top plate 33. A middle portion of each side plate 31 forms a stepped portion 311 rearward of the top plate 33. An inwardly bent soldering tab 312 is formed adjacent and to a rear of each stepped portion 311. Each side plate 31 further forms a tail portion 32 rearward of the soldering tab 312. A top edge of the stepped portion 311 is lower than a top edge of the tail portion 32 of the side plate 31. The tail portion 32 forms an outward protrusion 321 thereon. A rear tab 322 extends perpendicularly inward from a rear edge of the tail portion 32. A pair of rear plates 35 extend upwardly from rear edges of the first half 341 and the second half 342, respectively. A pair of flared pads 351 bend rearwardly and outwardly from an inward edge of each rear plate 35 and opposite to one another, thereby defining an entrance 37 therebetween for retaining the cable set 5. A rectangular tab 352 defined on each rear plate 35 opposite a corresponding flared pad 351 overlies a corresponding rear tab 322 of the tail portion 32. A pair of projecting portions 344 are formed on an engaging edge of the second half 342 of the bottom plate 34. A corresponding pair of notches 343 are defined in the first half 341 of the bottom plate 34.

The dielectric housing 1 comprises a main body 12, a mating tongue 13 extending forwardly from a front (not shown) of the main body 12, a rear body 15 extending rearwardly from a rear (not labeled) of the main body 12 and a retaining portion 11 extending rearwardly from the rear body 15. A plurality of channels 14 is defined in a top surface of the mating tongue 13 from a front of the mating tongue 13 through the main body 12 to a rear of the rear body 15, and in a top surface of the rear body 15. A pair of depressions 111 is defined in an upper surface of the retaining portion 11 at opposite lateral sides thereof for retaining the pair of soldering tabs 312, respectively. Two blocks 122 are formed at opposite sides of a top surface (not labeled) of the main body 12 and a recess 121 is defined in the top surface between the blocks 122. The plurality of terminals 4 is received in the corresponding channels 14.

Referring to FIG. 1, the shielded cable set 5 comprises a plurality of signal wires 52 and a grounding wire 51 surrounded by a shielding braid 50 and an outer coating of transparent insulation (not labeled). The grounding wire 51 is electrically connected to the shielding braid 50 at one end. Each signal wire 52 has an inner conductor 53. A predetermined length of each wire 51, 52 is exposed for connection to the connector 8.

Figure 3:
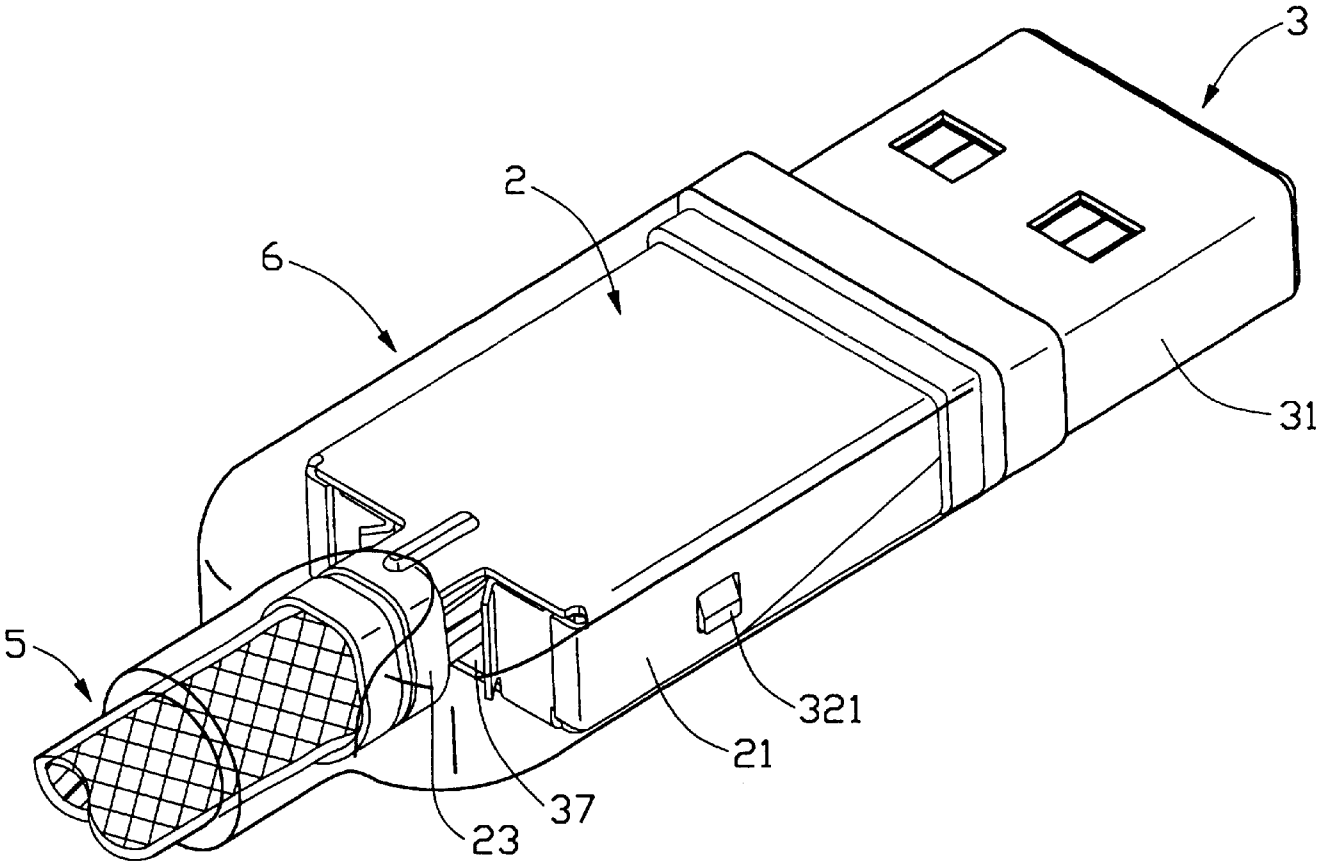
FIG. 3 is an assembled view of FIG. 1 with a transparent insulation thereon.
Figure 4:
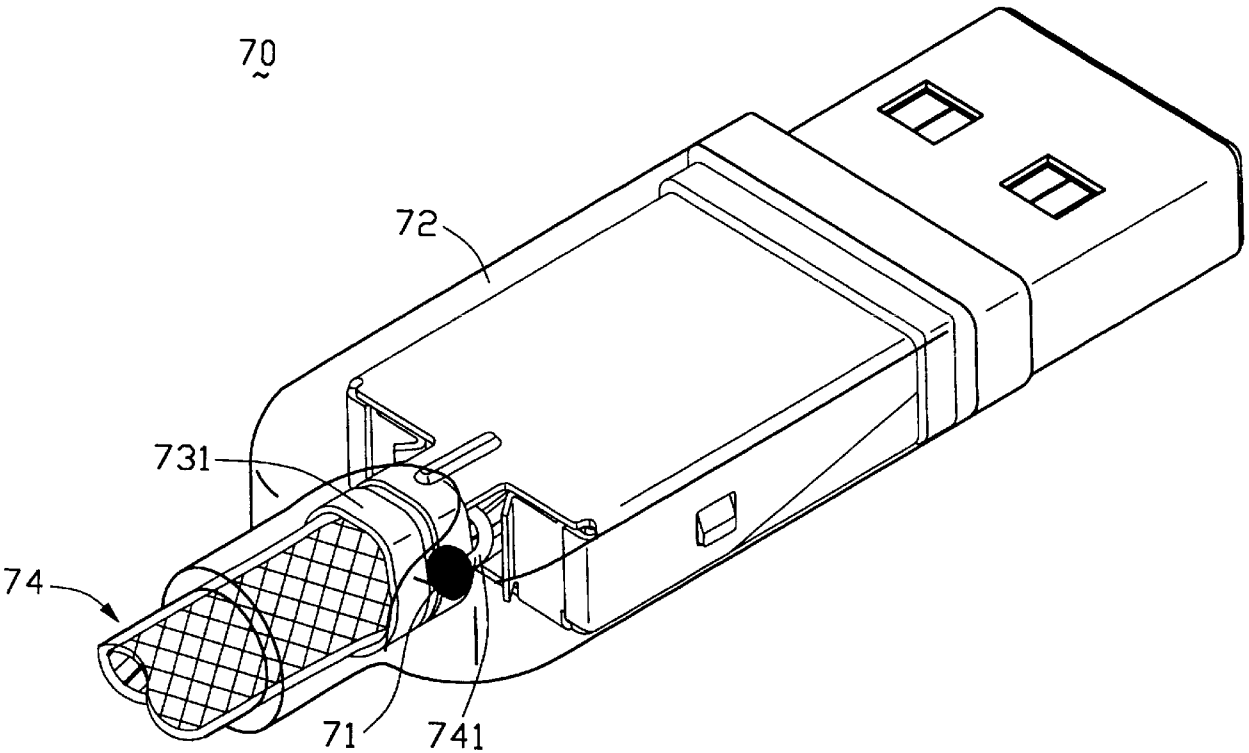
FIG. 4 (PRIOR ART)
FIG. 4 is a perspective view of a conventional cable connector assembly with a transparent insulation thereon.

In assembly, the dielectric housing 1 is fixed into the receiving space 30 of the lower shell 3 with the blocks 122 of the main body 12 engaging with the corresponding apertures 361 of the lower shell 3, a middle aperture 361 communicating with the recess 121 of the main body 12. The pair of soldering tabs 312 of the lower shell 3 are bent to engage with the depressions 111 of the retaining portion 11. The cable set 5 is received in the lower shell 3 through the entrance 37 thereof. A free end of the grounding wire 51 is soldered to one of the soldering tabs 312 of the lower shell 3 and the inner conductors 53 of the signal wires 52 are soldered to corresponding soldering portions 41 of the terminals 4 received in the channels 14. The upper shell 2 then is snapped onto the lower shell 3 with the detent 22 engaging with the middle aperture 361 and the protrusions 321 of the lower shell 3 engaging with the holes 211 of the upper shell 2, thereby securing the upper shell 2 to the lower shell 3. The collarlike strip 23 of the upper shell 2 is then crimped to the cable set 5. Referring to FIG. 3, a transparent insulating cover 6 is injected molded to the connector 8 and the cable set 5.

The grounding wire 51 is more reliably secured to the connector 8 and gives a more attractive appearance than in the cited prior art connector since it is attached intension to the lower shell 3 and upper shell 2. The grounding structure is clearly improved over the prior art and is more convenient to assemble.

It is to be understood, however, that even though numerous characteristics and advantages of the present invention have been set forth in the foregoing description, together with details of the structure and function of the invention, the disclosure is illustrative only, and changes may be made in detail, especially in matter of shape, size, and arrangement of parts within the principles of the invention to the full extent indicated by the broad general meaning of the terms in which the appended claims are expressed.

We claim:

1. A cable connector assembly, comprising:

a cable set having a plurality of wires surrounded by a shielding braid, wherein at least one wire is a grounding wire which connects with the shielding braid and at least one wire is a signal wire; and an electrical connector electrically connected to the cable set, comprising a dielectric housing with a plurality of channels defined therethrough, a shell covering the housing and a plurality of terminals received in the channels of the housing to electrically contact with corresponding signal wires of the cable set;

wherein a grounding wire is soldered to a soldering tab formed on the shell;

wherein the shell includes an upper shell and a lower shell;

wherein the lower shell comprises a top plate, a bottom plate and two opposite side plates defining a receiving space for receiving the housing;

wherein a soldering tab is defined on each side plate;

wherein the lower shell further defines a stepped portion adjacent to the soldering tab;

wherein the electrical connector is a Universal Serial Bus connector;

wherein the upper shell comprises a rectangular panel and a pair of side panels extending downwardly from two opposite sides of the rectangular panel;

wherein a detent is formed at a front of the rectangular panel of the upper shell;

wherein a strip is formed at a rear of the upper shell and connecting with the rectangular panel through a beam, and the strip is used for crimping the cable set to the upper shell.

* * * * *